US008833342B2

(12) United States Patent
Richter et al.

(10) Patent No.: US 8,833,342 B2
(45) Date of Patent: Sep. 16, 2014

(54) METHOD FOR REGULATING A QUANTITY CONTROL SOLENOID VALVE IN AN INTERNAL COMBUSTION ENGINE

(75) Inventors: Uwe Richter, Markgroeningen (DE); Peter Roth, Bangalore (IN); Joerg Kuempel, Stuttgart (DE); Matthias Maess, Boeblingen (DE)

(73) Assignee: Robert Bosch GmbH, Stuttgart (DE)

( * ) Notice: Subject to any disclaimer, the term of this patent is extended or adjusted under 35 U.S.C. 154(b) by 391 days.

(21) Appl. No.: 13/139,940

(22) PCT Filed: Dec. 3, 2009

(86) PCT No.: PCT/EP2009/066339

§ 371 (c)(1),
(2), (4) Date: Sep. 13, 2011

(87) PCT Pub. No.: WO2010/072536

PCT Pub. Date: Jul. 1, 2010

(65) Prior Publication Data

US 2011/0315124 A1 Dec. 29, 2011

(30) Foreign Application Priority Data

Dec. 16, 2008 (DE) ..... 10 2008 054 702

(51) Int. Cl.

| | |
|---|---|
| ***F02M 57/02*** | (2006.01) |
| ***F02M 63/02*** | (2006.01) |
| ***F02D 41/20*** | (2006.01) |
| ***F02M 59/36*** | (2006.01) |
| ***F02D 41/38*** | (2006.01) |
| ***F02D 41/24*** | (2006.01) |

(52) U.S. Cl.

CPC ..... *F02M 59/366* (2013.01); *F02M 63/0225* (2013.01); *F02D 41/20* (2013.01); *F02D 2250/31* (2013.01); *F02D 41/3845* (2013.01); *F02D 2200/0602* (2013.01); *F02D 41/2464* (2013.01)

USPC ..... 123/446; 123/447; 123/458; 361/154

(58) Field of Classification Search

USPC ..... 123/357, 480, 446, 447, 457, 458, 490, 123/472, 478, 510, 511; 361/154; 251/129.04; 137/487.5; 417/26, 28

See application file for complete search history.

(56) References Cited

U.S. PATENT DOCUMENTS 5,803,049 A 9/1998 Harcombe
5,924,435 A * 7/1999 Wall et al. ..... 137/1

(Continued)

FOREIGN PATENT DOCUMENTS

CN 1090909 8/1994
CN 101765713 6/2010

(Continued)

OTHER PUBLICATIONS

International Search Report, PCT International Patent Application No. PCT/EP 2009/066339, Dated Mar. 18, 2010.

*Primary Examiner* — Erick Solis
*Assistant Examiner* — Carl Staubach
(74) *Attorney, Agent, or Firm* — Kenyon & Kenyon LLP

(57) ABSTRACT

A method for regulating a fuel injection system of an internal combustion engine, wherein the fuel injection system includes a high-pressure pump which is associated with a quantity control valve having a solenoid valve electromagnetically operable by a coil for supplying fuel, the quantity control valve regulating the fuel quantity pumped by the high pressure pump and the coil of the solenoid valve being energized according to a setpoint current value in order to close the valve for supplying fuel to the high-pressure pump; when the solenoid valve closes, the setpoint current value is reduced from a first current setpoint value to a second current setpoint value so that an emission of audible noise generated when the solenoid valve closes during operation of the internal combustion engine is at least partially reduced.

9 Claims, 4 Drawing Sheets

(56) References Cited

U.S. PATENT DOCUMENTS

| | | | | |
|---|---|---|---|---|
| 6,119,655 | A | 9/2000 | Heinitz et al. | |
| 7,013,876 | B1 | 3/2006 | Puckett et al. | |
| 7,917,310 | B2 * | 3/2011 | Pearce et al. | 702/38 |
| 8,402,952 | B2 * | 3/2013 | Haaf et al. | 123/499 |
| 2005/0066940 | A1 | 3/2005 | Sheikh et al. | |
| 2010/0237266 | A1 | 9/2010 | Haaf et al. | |

FOREIGN PATENT DOCUMENTS

| | | |
|---|---|---|
| DE | 19802583 | 8/1999 |
| EP | 1103709 | 5/2001 |
| WO | WO 2004/005687 | 1/2004 |
| WO | WO 2004/007934 | 1/2004 |
| WO | WO 2006/060545 | 6/2006 |
| WO | WO 2009/016044 | 2/2009 |

* cited by examiner

METHOD FOR REGULATING A QUANTITY CONTROL SOLENOID VALVE IN AN INTERNAL COMBUSTION ENGINE

FIELD OF THE INVENTION

The present invention relates to a method for regulating a fuel injection system of an internal combustion engine, the fuel injection system including a high-pressure pump, which is associated with a quantity control valve having a solenoid valve electromagnetically operated by a coil for delivering fuel, the quantity control valve regulating the fuel quantity pumped by the high-pressure pump and the coil of the solenoid valve being energized by a first current value to close the solenoid valve for delivering fuel to the high-pressure pump.

BACKGROUND INFORMATION

A method for regulating a fuel injection system having a quantity control valve is available. A quantity control valve of this type is usually implemented as a solenoid valve which is electromagnetically operated by a coil and has an armature and associated stroke limiting stops. The solenoid valve is open in the de-energized state of the coil. To close the solenoid valve, the coil is activated by a constant voltage—the battery voltage—whereupon the current in the coil increases in a characteristic manner. The time between the application of the voltage and the point in time when the solenoid valve closes is referred to as actuation time. After the voltage is shut off, the current drops again in a characteristic manner and the solenoid valve opens shortly after the current has dropped. The time between shutting off the voltage across the coil and the opening of the valve is referred to as extinguishing time.

In order to increase the actuation time of the solenoid valve and thus to reduce the impact velocity of the armature, the voltage applied to the coil for closing the solenoid valve may be reduced before the solenoid valve reaches an appropriate end position, i.e., before the armature hits the stroke limiting stops. The coil current and thus also the magnetic force quickly increases due to the initially applied voltage to quickly start the armature movement. An unnecessary increase in the coil current is then avoided due to the reduction of the applied voltage. The reduction may occur either before or after a certain force value at which the armature starts moving has been reached. It is important here to ensure a reliable actuation of the armature.

If the selected current in the solenoid valve is too low in operation of a fuel injection system of this type, its actuation time may occasionally be so long that the solenoid valve does not completely close in a certain actuation phase and thus sufficient high pressure may not be built up in the high-pressure pump.

In order to avoid this, the current is established so that it always ensures that the solenoid valve closes. However, the established current is often selected to be so high that it achieves a relatively quick actuation of the solenoid valve and thus produces a correspondingly high impact velocity of the armature against the stroke limiting stops, which results in a hard impact of the armature against the stroke limiting stops. In this case an audible sound is produced, which is emitted by the internal combustion engine and may be perceived as unpleasant and disturbing.

SUMMARY

An object of the present invention is to provide a method and a device which allow the audible sound to be reduced when the quantity control solenoid valve is activated.

This object may be achieved by an example method for regulating a fuel injection system of an internal combustion engine. The fuel injection system includes a high-pressure pump which is associated with a quantity control valve having a solenoid valve electromagnetically operated by a coil for delivering fuel. The quantity control valve regulates the fuel quantity delivered by the high-pressure pump. The coil of the solenoid valve is energized according to a setpoint value for the current in the coil in order to close it for delivering fuel to the high-pressure pump. The setpoint value of the current in coil 21 is reduced from a predefined first current setpoint value to a second current setpoint value in such a way that an emission of audible sound which is produced during operation of the internal combustion engine when the solenoid valve closes is at least partially reduced.

The present invention thus allows the audible sound to be reduced during operation of the internal combustion engine so that it is subjectively perceived as more pleasant and quieter.

In accordance with the present invention, the second current setpoint value corresponds to a minimum current value through which full closing of the solenoid valve is achievable during operation of the internal combustion engine.

Maximum reduction of the audible sound may thus be achieved.

The high-pressure pump is connected to a pressure accumulator to which at least one injector is connected. An actual pressure value of the pressure accumulator is compared to an associated setpoint pressure value for determining the minimum current value. To determine the minimum current value, a failure current value is preferably ascertained, at which the difference between the actual pressure value and the setpoint pressure value exceeds a predefined threshold value, the ascertained failure current value being increased by a predefined safety offset.

Full closing of the solenoid valve is ensured by increasing the ascertained failure current value by the predefined safety offset.

As an alternative, a setpoint pressure value required for the operation may be predefined by an associated pressure regulator for the high-pressure pump which is connected to a pressure accumulator, the minimum current value being determined as a function of an increase in the setpoint pressure value during operation of the internal combustion engine. To determine the minimum current value, a failure current value is ascertained, at which the increase in the setpoint pressure value exceeds a predefined threshold value, the ascertained failure current value being increased by a predefined safety offset.

The present invention may thus be advantageously cost-effectively implemented using existing components and elements, a reliable and full closing of the solenoid valve being ensured by the increase in the ascertained failure current value by the predefined safety offset.

According to the present invention, the solenoid valve has an armature which is attracted to the associated stroke limiting stops for closing the solenoid valve, the audible sound being produced by the impact of the armature against the stroke limiting stops. By reducing the setpoint value for the current in the coil from the first current setpoint value to the second current setpoint value, an activation response of the solenoid valve is slowed down, to reduce a corresponding impact velocity of the armature against the stroke limiting stops.

Due to the reduction of the impact velocity, the audible sound produced when the armature hits the stroke limiting stops is reduced.

An example computer program is also provided for performing a method for regulating a fuel injection system of an internal combustion engine, the fuel injection system including a high-pressure pump, which is associated with a solenoid valve electromagnetically operated by a coil for delivering fuel, the quantity control valve regulating the fuel quantity delivered by the high-pressure pump and the coil of the solenoid valve being energized according to a setpoint value for the current in the coil to close the solenoid valve for delivering fuel to the high-pressure pump. The computer program reduces the setpoint value for the current in the coil from a predefined first setpoint value to a predefined second setpoint value when the solenoid valve closes, in such a way that an emission of audible sound produced when the solenoid valve closes during operation of the internal combustion engine is at least partially reduced.

An example internal combustion engine is also provided having a fuel injection system which includes a high-pressure pump which is associated with a quantity control valve having a solenoid valve electromagnetically operated by a coil for supplying fuel, the fuel quantity delivered by the high-pressure pump being regulated by the quantity control valve by energizing the coil of the solenoid valve according to a setpoint value for the current in the coil to close the solenoid valve delivering fuel to the high-pressure pump. The setpoint value for the current in the coil is reduced from a predefined first current setpoint value to a second current setpoint value when the solenoid valve closes, in order to at least partially reduce an emission of audible sound which is produced during operation of the internal combustion engine when the solenoid valve closes.

BRIEF DESCRIPTION OF THE DRAWINGS

An exemplary embodiment of the present invention is explained below in greater detail with reference to the figures.

DETAILED DESCRIPTION OF EXAMPLE EMBODIMENTS

Figure 1:
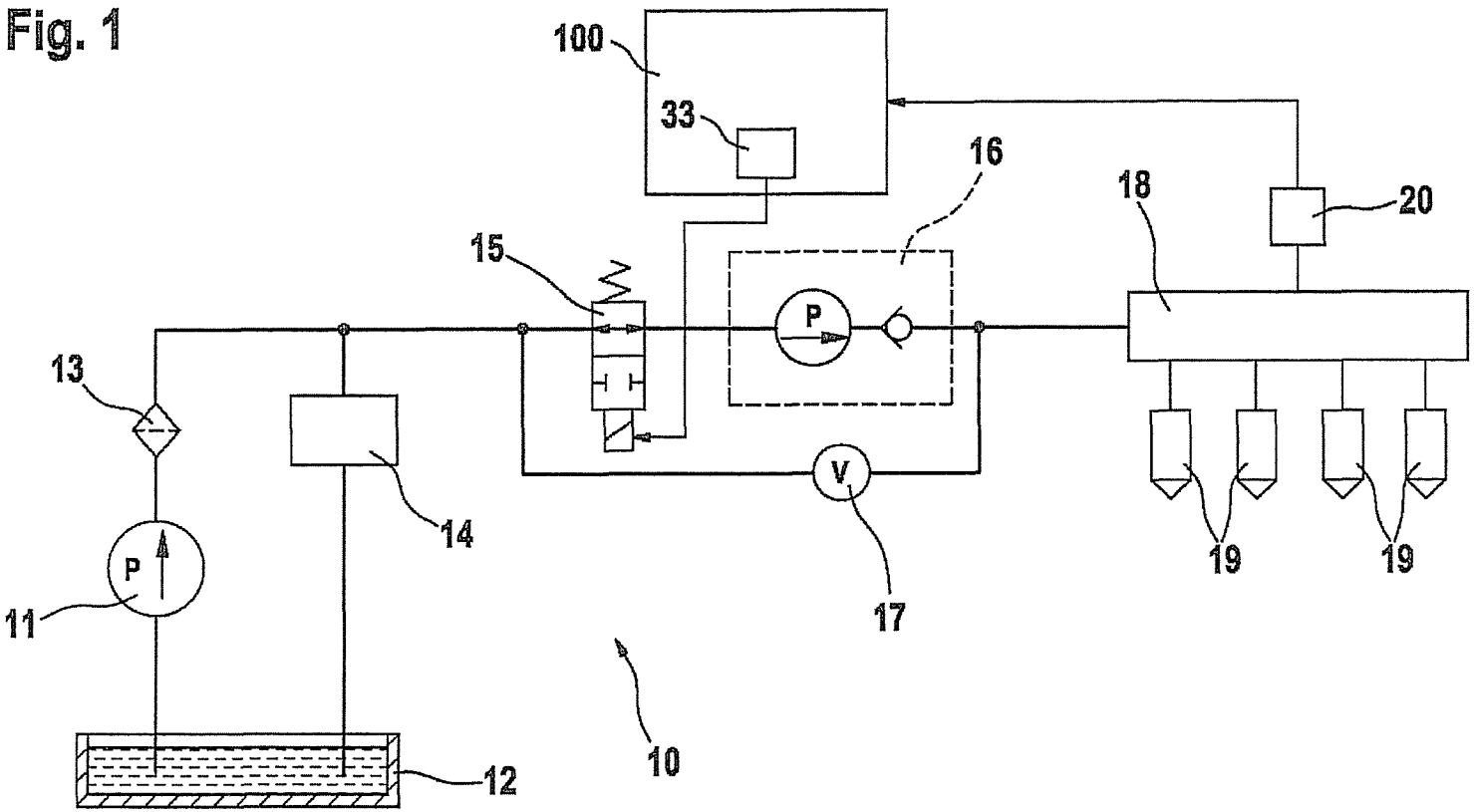
FIG. 1 shows a schematic diagram of a fuel injection system of an internal combustion engine having a high-pressure pump and a quantity control valve.

FIG. 1 shows a schematic diagram of a fuel injection system 10 of an internal combustion engine. It includes an electric fuel pump 11 which pumps fuel from a fuel tank 12 and further via a fuel filter 13. Fuel pump 11 is suitable for producing a low pressure. For controlling and/or regulating this low pressure, low pressure regulator 14 is provided, which is connected to the outlet of fuel filter 13 and via which fuel may be recirculated back to fuel tank 12. A series circuit of a quantity control valve 15 and a mechanical high-pressure pump 16 is furthermore connected to the outlet of fuel filter 13. The outlet of high-pressure pump 16 is connected to the inlet of quantity control valve 15 via a pressure relief valve 17. The outlet of high-pressure pump 16 is furthermore connected to a pressure accumulator 18 to which a plurality of injectors 19 is connected. A pressure regulator 33 predefines a setpoint pressure value to be generated by high-pressure pump 16 for pressure accumulator 18. Pressure accumulator 18 is often referred to as rail or common rail. Furthermore, a pressure sensor 20 is connected to pressure accumulator 18. The activation of quantity control valve 15 and pressure regulator 33 is implemented, for example, by a computer program on a control and regulating device 100, utilizing the actual pressure value of pressure sensor 20.

Fuel injection system 10 illustrated in FIG. 1 is used, in the present example, for supplying injectors 19 of a four-cylinder internal combustion engine with sufficient fuel and the required fuel pressure, so that reliable injection and reliable operation of the internal combustion engine are ensured.

Figure 2:
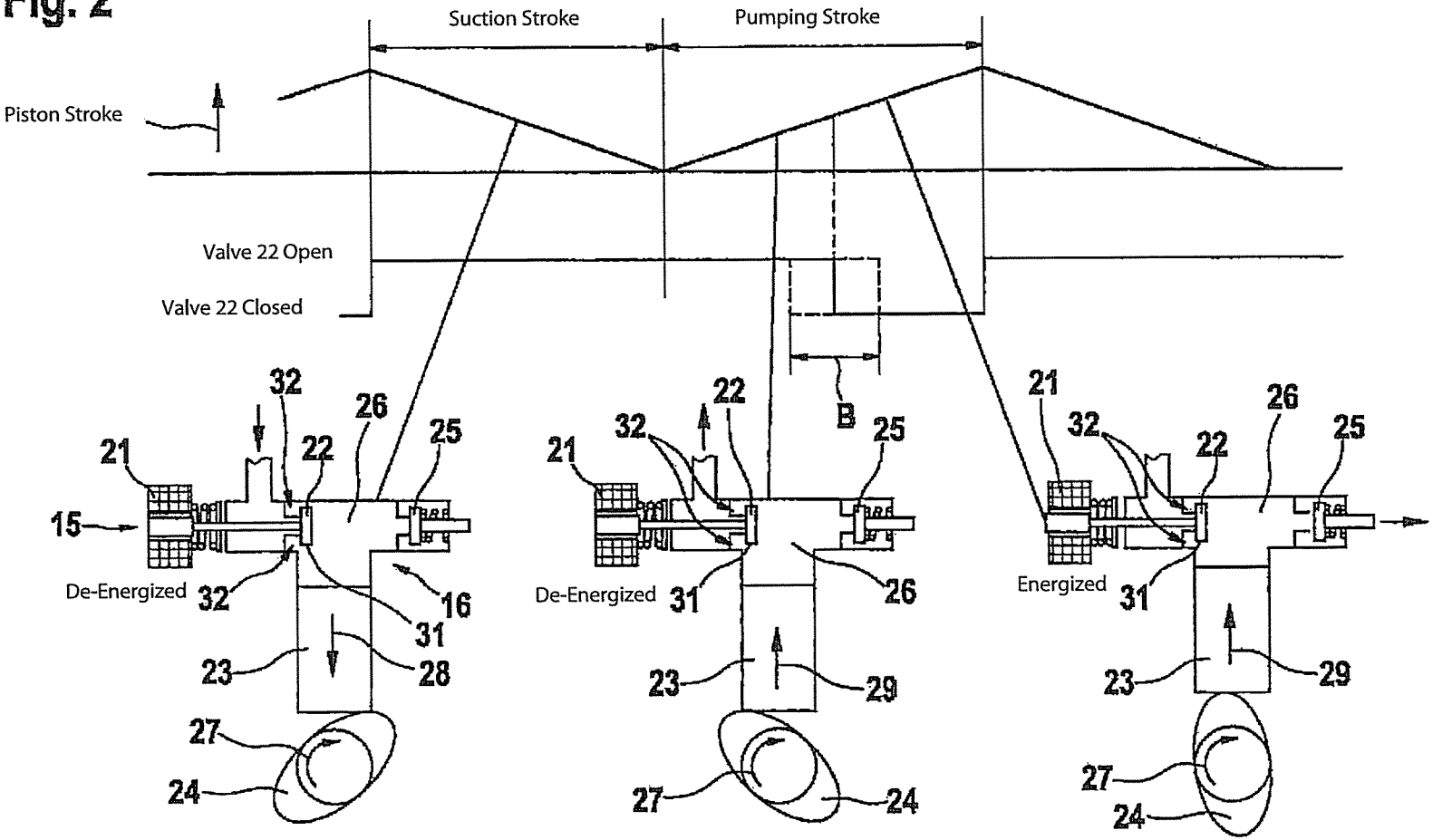
FIG. 2 shows a schematic diagram of different function states of the high-pressure pump of FIG. 1, including an associated time diagram.

The mode of operation of quantity control valve 15 and high-pressure pump 16 is illustrated in detail in FIG. 2. Quantity control valve 15 is designed as a normally open solenoid valve 22 and has a coil 21 via which solenoid valve 22 may be closed or opened by applying and shutting off an electric current or an electric voltage. High-pressure pump 16 has a piston 23, which is actuated by a cam 24 of the internal combustion engine. Furthermore, high-pressure pump 16 is provided with a valve 25. A pumping space 26 of high-pressure pump 16 is provided between solenoid valve 22, piston 23, and valve 25.

Pumping space 26 may be separated from a fuel supply by electric fuel pump 11 and thus from the low pressure by solenoid valve 22. Pumping space 26 may be separated from pressure accumulator 18 and thus from the high pressure by valve 25.

In the initial state as illustrated in FIG. 2 on the left, solenoid valve 22 is open and valve 25 is closed. Open solenoid valve 22 corresponds to the de-energized state of coil 21. Valve 25 is held closed by the pressure of a spring or the like.

The left-hand illustration of FIG. 2 shows the suction stroke of high-pressure pump 16. When cam 24 rotates in the direction of arrow 27, piston 23 moves in the direction of arrow 28. Due to the open solenoid valve 22, fuel, which has been pumped by electric fuel pump 11, thus flows into pumping space 26.

The central illustration of FIG. 2 shows the pumping stroke of high-pressure pump 16, coil 21 still being de-energized and thus solenoid valve 22 still being open. Due to the rotation of cam 24, piston 23 moves in the direction of arrow 29. Due to the open solenoid valve 22, fuel is thus pumped from pumping space 26 back in the direction of fuel pump 11. This fuel is then returned to fuel tank 12 via low pressure regulator 14.

In the right-hand illustration of FIG. 2, as in the central illustration, the pumping stroke of high-pressure pump 16 is shown again. Unlike in the central illustration, however, coil 21 is now energized and thus solenoid valve 22 is closed. This results in a pressure build-up in pumping space 26 due to the further stroke movement of piston 23. When the pressure prevailing in pressure accumulator 18 is reached, valve 25 is opened and the residual [fuel] quantity is pumped into the pressure accumulator.

The quantity of the fuel pumped to pressure accumulator 18 depends on when solenoid valve 22 assumes its closed state. The sooner solenoid valve 22 is closed, the more fuel is pumped into fuel accumulator 18 via valve 25. This is illustrated in FIG. 2 by an area B identified with an arrow.

As soon as piston 23 in the right-hand illustration of FIG. 2 has reached its maximum piston stroke, no more fuel may be pumped by piston 23 to pressure accumulator 18 via valve 25. Valve 25 closes. Furthermore, coil 21 is de-energized again, so that solenoid valve 22 opens again. Thereupon, piston 23, moving in the direction of arrow 28 in the left-hand illustration of FIG. 2, may again aspirate fuel of the electric fuel pump into pumping space 26.

A method for controlling fuel injection system 10 of FIG. 1 according to a specific embodiment of the present invention is described in detail below, with reference to FIGS. 3 and 4.

Figure 3:
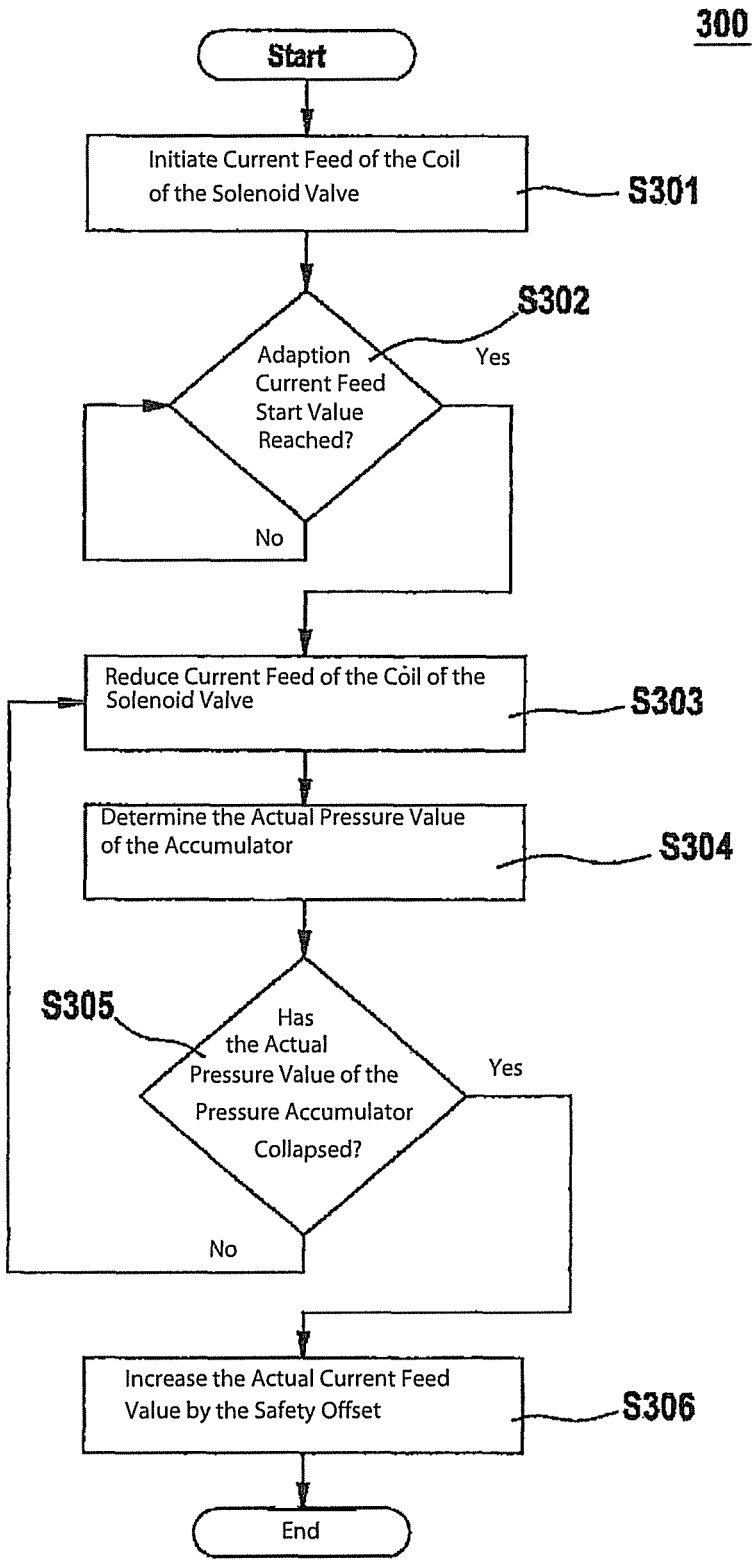
FIG. 3 shows a flow chart of a method for regulating the quantity control valve of FIG. 1.

FIG. 3 shows a flow chart of a method 300 for regulating fuel injection system 10 of the internal combustion engine of FIGS. 1 and 2 for reducing the audible sound produced during operation of the internal combustion engine when quantity control valve 15 is switched ON. According to a preferred specific embodiment of the present invention, method 300 is implemented as a computer program, which is executable by a suitable regulating device, which is already provided in the internal combustion engine. The present invention may thus be implemented in a simple and cost-effective manner using existing components of the internal combustion engine.

In the following description of the method according to the present invention, a detailed explanation of conventional method steps is dispensed with.

Method 300 starts in step S301 by energizing coil 21 of solenoid valve 22 in a controlled manner. For this purpose, in one specific embodiment of the present invention, an activation voltage applied to coil 21 may be turned off, so that a corresponding current is induced in coil 21. For regulating the current, a setpoint value of the current in coil 21 is set at a first current setpoint value. The predefined first current setpoint value is predefined, for example, as a function of the time from a suitable characteristics curve. The current in coil 21 is measured and regulated so that it follows the setpoint curve.

In step S302, the measured coil current is compared with a predefined adaption energizing start value, which may be determined, for example with the aid of a suitable characteristic map. As long as the measured coil current is less than the predefined adaption energizing start value, the measurement of the coil current and comparison of the measured coil current with the predefined adaption energizing start value continues according to step S302. If the measured coil current is equal to or greater than the predefined adaption energizing start value, method 300 continues in step S303.

In step S303, the setpoint value for the current in coil 21 is reduced from its instantaneous value to a predefined second current setpoint value. The second current setpoint value is predefined, for example according to a characteristics curve corrected by a correction factor. The characteristics curve represents the second current setpoint value as a function of time. The correction factor affects the current level. Starting from value 1, the correction factor is reduced, for example, by a predefined value at each step S303, for example, by 0.2, until a pre-defined minimum value, for example 0.2, is reached. As an alternative, multiple characteristics curves having different current levels may also be saved in a memory. In this case, a characteristics curve having a lower current level than in the previous run of step S303 is selected in each run of step S303 for ascertaining the second current setpoint value. The current in coil 21 is regulated according to the thus modified setpoint value for the current in coil 21. A step S304 is then executed.

In step S304, an instantaneous actual pressure value of pressure accumulator 18 is determined, for example by using pressure sensor 20. A step S305 is then executed.

In step S305, it is determined, as explained below, whether the instantaneous actual pressure value of pressure accumulator 18 has collapsed. If this is not the case, method 300 returns to step S303, where the instantaneous setpoint value for the current in coil 21 is reduced again. Accordingly, a plurality of consecutive reductions may be performed (adaption).

In order to determine, in step S305, whether the instantaneous actual pressure value of pressure accumulator 18 has collapsed, the actual pressure value is compared, according to the present invention, with a setpoint pressure value, which is predefined by pressure regulator 33. If the difference between the actual pressure value and the setpoint pressure value exceeds a predefined threshold value, it is assumed that the actual pressure value has collapsed, whereupon method 300 continues in step S306. As an alternative, a collapse of the actual pressure value may also be assumed if pressure regulator 33 increases the setpoint pressure value in such a way that this increase exceeds a predefined increase threshold value.

In step S306 it is assumed that, at the reduced current value by which coil 21 is energized when it is assumed that the instantaneous actual pressure value of pressure accumulator 18 has collapsed, full closing of solenoid valve 22 is no longer ensured. If solenoid valve 22 no longer closes completely, high-pressure pump 16 fails, i.e., pumping of fuel by high-pressure pump 16 is reduced at least to the point that a sufficiently high pressure may no longer be built up in pressure accumulator 18. Therefore, the instantaneous current level, or the actual current energizing coil 21 at this point in time, is also referred to as "failure current value."

In order to ensure that solenoid valve 22 always closes reliably and completely during further operation of the internal combustion engine, the ascertained failure current value is increased in step S306 by a predefined safety offset, a minimum current value being determined by which coil 21 of solenoid valve 22 is to be energized during operation of the internal combustion engine in order to close solenoid valve 22 reliably and completely.

During further operation of the internal combustion engine, the current feed to solenoid valve 22 may thus be reduced to this minimum at an appropriate closing operation when the adaption energizing start value is reached. This maximizes the actuation time of solenoid valve 22, so that the impact velocity of armature 31 against stroke limiting stops 32 may be minimized and thus the generated audible sound may be reduced.

Figure 4:
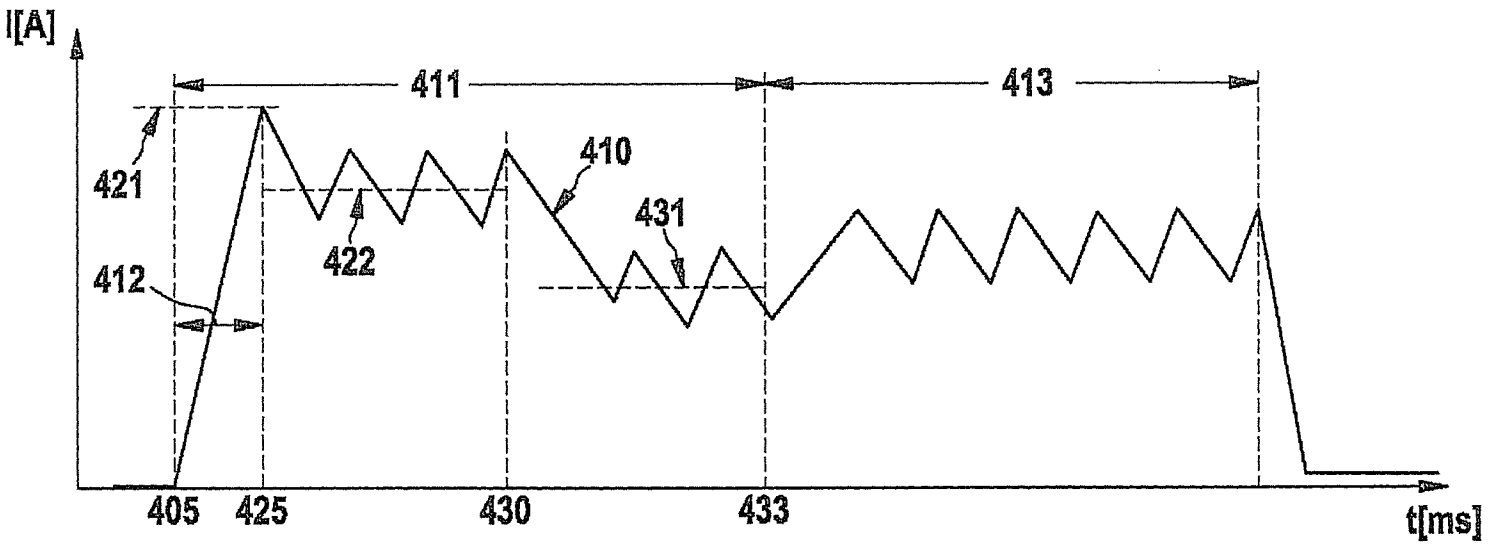
FIG. 4 shows a schematic diagram of the variation over time of the required activation voltage or current feed of the solenoid valve of FIG. 1 in the case of an activation in accordance with to the present invention.

FIG. 4 shows a diagram 400, which contains an exemplary curve 410 of the current over time. Diagram 400 illustrates an activation of solenoid valve 22 according to one specific embodiment of the present invention. It begins at a point in time 405, at which the activation voltage $U_{Bat}$ applied to coil 21 of solenoid valve 22 is turned on for an actuation pulse length 412 as described with reference to step S301 of FIG. 3. This makes the current in coil 21 increase up to point in time 425 to a current value 421.

In the present exemplary embodiment, current curve 410 represents the adaption energizing start value according to step S302 of FIG. 3. Accordingly, the adaption according to the present invention begins with this current curve 410 as described above with reference to step S303 of FIG. 3. As illustrated in FIG. 4, the current is regulated according to the setpoint current value in coil 21. This reduces adaption energizing start value 421 to a reduced current value 422. The setpoint current value in coil 21 is then reduced to a lower second current setpoint value 431 in a further step at a point in time 430, and then regulated to a point in time 433. At point in time 433, an actuation phase 411 required for closing solenoid valve 22 is terminated and solenoid valve 22 closes, so that point in time 433 is also referred to as closing point in time. The adaption according to the present invention reduces one or more current values 421, 422, 431 stepwise until termination condition S305 is met. This reduces current curve 410 stepwise during actuation phase 411.

After closing solenoid valve 22, it is held closed for a predefined holding phase 413, after which the activation voltage is set to 0 again, until the next subsequent closing operation. This reduces the energizing current of solenoid valve 22 again, so that it re-opens.

As apparent from FIG. 4, a relatively long actuation phase 411 is implemented with the activation of solenoid valve 22 according to the present invention. The impact velocity of armature 31 against stroke limiting stops 32 is reduced and thus the generated audible sound is substantially reduced.

What is claimed is:

1. A method for regulating a fuel injection system of an internal combustion engine, the fuel injection system including a high-pressure pump which is associated with a quantity control component that includes a solenoid valve and a coil for electromagnetically operating the solenoid valve to supply fuel, the quantity control component valve regulating a quantity of fuel pumped by the high-pressure pump, the method comprising:

to close the solenoid valve for supplying fuel to the high-pressure pump:

energizing the coil to increase a current in the coil;

measuring a current in the coil; and in accordance with the measurement, regulating the current in the coil;

wherein:

the regulating includes:

reducing the current towards a first setpoint value; and subsequently reducing the current towards a second setpoint value that is lower than the first setpoint value;

the reduction of the current towards the first and second setpoint values is performed during the closing of the solenoid valve;

the second setpoint value corresponds to a minimum current value using which complete closing of the solenoid valve during operation of the internal combustion engine is achievable;

the high-pressure pump is connected to a pressure accumulator to which at least one injector is connected; and for determining the minimum current value, an actual pressure value of the pressure accumulator is compared to an associated setpoint pressure value.

2. The method as recited in claim 1, wherein, for determining the minimum current value, a failure current is ascertained, at which a difference between the actual pressure value and the setpoint pressure value exceeds a predefined threshold value, the ascertained failure current value being increased by a predefined safety offset.

3. The method as recited in claim 1, wherein the minimum current value is determined as a function of an increase in the setpoint pressure value during operation of the internal combustion engine.

4. The method as recited in claim 3, wherein, for determining the minimum current value, a failure current value is ascertained, at which the increase of the setpoint pressure value exceeds a predefined threshold value, the ascertained failure current value being increased by a predefined safety offset.

5. The method as recited in claim 1, wherein the solenoid valve has an armature which is attracted against associated stroke limiting stops for closing the solenoid valve, an audible sound being generated by an impact of the armature against the stroke limiting stops, and wherein an attraction response of the solenoid valve is slowed down by the reductions of the current in the coil, in order to reduce a corresponding impact velocity of the armature against the stroke limiting stops.

6. A non-transitory storage medium storing a computer program for a method for regulating a fuel injection system of an internal combustion engine, the fuel injection system including a high-pressure pump which is associated with a quantity control component that includes a solenoid valve and a coil for electromagnetically operating the solenoid valve to supply fuel, the quantity control component regulating a quantity of fuel pumped by the high-pressure pump, the computer program, when executed by a controller, causing the controller to perform the steps of:

to close the solenoid valve for supplying fuel to the high-pressure pump:

energizing the coil to increase a current in the coil;

measuring a current in the coil; and in accordance with the measurement, regulating the current in the coil;

wherein:

the regulating includes:

reducing the current towards a first setpoint value; and subsequently reducing the current towards a second setpoint value that is lower than the first setpoint value;

the reduction of the current towards the first and second setpoint values is performed during the closing of the solenoid valve;

the second setpoint value corresponds to a minimum current value using which complete closing of the solenoid valve during operation of the internal combustion engine is achievable;

the high-pressure pump being is connected to a pressure accumulator to which at least one injector is connected; and for determining the minimum current value, an actual pressure value of the pressure accumulator is compared to an associated setpoint pressure value.

7. A fuel injection system for an internal combustion engine, the fuel injection system comprising:

a high-pressure pump;

a quantity control component that includes a solenoid valve and a coil adapted for electromagnetically operating the solenoid valve to supply fuel, the quantity control component being arranged for regulating a quantity of fuel pumped by the high-pressure pump; and a controller adapted for controlling the quantity control component, the controlling including, to close the solenoid valve for supplying fuel to the high-pressure pump:

measuring a current in the coil; and in accordance with the measurement, regulating the current in the coil;

wherein:

the regulating includes:

subsequent to an initial energizing of the coil to increase a current in the coil, reducing the current towards a first setpoint value; and subsequently reducing the current towards a second setpoint value that is lower than the first setpoint value;

the reduction of the current towards the first and second setpoint values is performed during the closing of the solenoid valve;

the second setpoint value corresponds to a minimum current value using which complete closing of the solenoid valve during operation of the internal combustion engine is achievable;

the high-pressure pump is connected to a pressure accumulator to which at least one injector is connected; and for determining the minimum current value, an actual current value of the pressure accumulator is compared to an associated setpoint pressure value.

8. The method as recited in claim 1, wherein the second setpoint value is set by executing an iterative reduction, by a predetermined amount, from the first setpoint value.

9. The method as recited in claim 1, wherein the reduction of the current towards the first setpoint value follows a setpoint curve.

* * * * *